US005870815A

United States Patent [19]

Karner et al.

[11] Patent Number: 5,870,815

[45] Date of Patent: Feb. 16, 1999

[54] APPARATUS AND METHOD FOR ALIGNING A GOLF CLUB FOR ATTACHING A HANDLE GRIP

[75] Inventors: James E. Karner, Grayslake; Jessica A. Laprade, Des Plaines, both of Ill.

[73] Assignee: Tommy Armour Golf Company, Morton Grove, Ill.

[21] Appl. No.: 903,449

[22] Filed: Jul. 30, 1997

[51] Int. Cl.[6] ..... B23Q 17/00

[52] U.S. Cl. ..... 29/407.1; 33/533; 29/464; 29/281.1

[58] Field of Search ..... 29/402.08, 407.04, 29/407.09, 407.1, 450, 464, 235, 234, 271, 281.1, 282; 33/508, 645, 533

[56] References Cited

U.S. PATENT DOCUMENTS

| | | | |
|---|---|---|---|
| 1,663,694 | 7/1928 | Fetter . | |
| 2,604,661 | 8/1952 | Karns . | |
| 3,631,602 | 1/1972 | Noel | 33/508 |
| 4,869,304 | 9/1989 | Gore . | |
| 4,899,428 | 2/1990 | Hsu . | |
| 4,958,424 | 9/1990 | Hsu | 29/252 |
| 5,178,711 | 1/1993 | Lu . | |
| 5,373,616 | 12/1994 | Biersdorf et al. . | |
| 5,407,026 | 4/1995 | Vald'via | 184/82 |
| 5,421,098 | 6/1995 | Muldoon | 33/508 |
| 5,644,853 | 7/1997 | Dixon | 33/533 |
| 5,771,552 | 6/1998 | Karner et al. | 29/407.01 |

*Primary Examiner*—David P. Bryant
*Attorney, Agent, or Firm*—Tilton, Fallon, Lungmus & Chestnut

[57] ABSTRACT

An apparatus and method for maintaining proper alignment of an iron-style golf club prior to and during installation of a handle grip includes generally U-shaped shaft supports and a biased, preferably gravity-driven, self-adjusting, leading edge alignment assembly creating a vertical plane defined by at least a pair of parallel horizontal rails positioned one over the other, the horizontal rails being slidable along inclined linear bearings to facilitate adjustment until the leading edge of the strike face of an iron-style club head contacts two of the rails to ensure vertical alignment. A clamp is further provided to lock a properly aligned iron-style golf club in place prior to installing a handle grip on the butt-end of the shaft.

15 Claims, 2 Drawing Sheets

APPARATUS AND METHOD FOR ALIGNING A GOLF CLUB FOR ATTACHING A HANDLE GRIP

BACKGROUND

1. Field of the Invention

This invention relates generally to providing handle grips on golf clubs and, more specifically, to a method and apparatus for ensuring a consistent alignment of golf clubs in a given set of iron-style clubs to ensure handle grips are installed with a similar orientation throughout the set of clubs.

2. Description of the Related Art

A well-known procedure for installing handle grips onto golf clubs includes first applying a double sided adhesive tape (known in the art as grip tape) to the handle (butt) end of a golf club shaft, second, covering the taped portion of the club shaft with an activating solvent, which not only activates the bonding of the handle grip to the tape, but also provides lubrication to facilitate the final step, which is installing the handle grip onto the taped portion of the shaft.

If handle grips were perfectly cylindrical and uniform, there would be no need to achieve a particular alignment of a golf club prior to installing a grip. However, modern handle grips for golf clubs typically have complex shapes, for example, they frequently include an interior axial "reminder" ridge that when the grip is installed on a cylindrical club shaft, results in a tear drop, ovalate shape to the grip that provides a golfer with a comfortable fit when holding the club. Golf club grips may also feature a logo or insignia identifying the manufacturer or model of the golf club, or have a repeating design. Additionally, they may include raised or grooved patterns, dimples, or other relief to provide tactile feedback in order to assist and assure the golfer's consistent and proper gripping of the club. Such complex designs for handle grips create a need for reliable, uniform means of alignment of the golf club just prior to and during installation of the grip so as to ensure consistent alignment of the grips relative to all the irons in a given set. This consistent alignment is important in order to achieve the club head's strike face's proper alignment to the target, and to avoid distractions to a golfer that might otherwise occur if different irons in a particular set of clubs had even slightly varying grip orientations relative to their corresponding club shafts.

One technique for aligning golf clubs to prepare for installing handle grips has been to simply clamp the shaft of the club using a vise-like device, as shown in Karns, U.S. Pat. No. 2,604,661. Because handle grips are typically installed at a late stage of manufacture of a golf club, usually after the permanent mounting of a club head to the club's shaft, a better technique for obtaining consistent alignment is to utilize the club head as a reference while positioning the overall club for installation of a handle grip. Hsu, U.S. Pat. No. 4,899,428, and Gore, U.S. Pat. No. 4,869,304, show handle grip mounting stations that use a head seat to align a club for grip installation.

There are several drawbacks associated with the alignment system disclosed in the prior art. For example, the design of the head seat in Gore (U.S. Pat. No. 4,869,304) is dependent on the shape of the particular club head to be seated therein, thus every different club head design requires a different head seat. Also, that alignment system does not compensate for varying shaft lengths. Another drawback is that because the shaft is not securely clamped, only a limited amount of force can be applied when installing a handle grip before the club will prematurely dislodge from the alignment system. Further, while the Hsu (U.S. Pat. No. 4,899,428) alignment system does have a shaft clamping means, it again has a seat design that is dependent on club head shape. Such head seats make multiple, unnecessary contact points with an iron club head, which can lead to undesired nicks, scratches, or gouges in the club head. If protective plastic is used over the club head prior to alignment, i.e. to avoid damaging the club head, the accuracy of the alignment with such prior head seats can be adversely effected, especially if the plastic is gathered.

Known alignment systems also suffer in that they require regular adjustment if they are to compensate for clubs of different lofts, different shaft lengths, and different offsets. Previously, the only means for adjustment has been to mount the head seat on horizontal and vertical sliding tracks. Thus, an operator has to adjust the head seat each time a club of different loft, length, or offset is to be gripped. This adversely effects production time. The only way to reduce production time with such a device is to provide grips on large quantities of a single loft of clubs, such as 3-irons, then reset the head seat for the next lofted clubs, i.e. 4-irons, and continue making adjustments in this fashion until all the different irons to be produced are gripped. Although this production system may reduce time spent adjusting the head seat, it creates a drain on valuable manufacturing floor space due to a need to stock large quantities of the respective club lofts, as opposed to cellular manufacturing procedures for assembling and completing sets of clubs as soon as each successive club for a given set of irons has been provided with a grip.

BRIEF SUMMARY OF THE INVENTION

The present invention overcomes the drawbacks of the conventional apparatus and methods for aligning iron-style golf clubs prior to handle grip installation and helps substantially reduce set-up time. It does this by using a gravity-driven, self-adjusting vertical plane defined by two or more horizontal contact rails or pins, positioned one over the other, supported by inclined linear bearings. The shaft of the iron club rests in one or more U-shaped shaft supports, and the operator rotates the iron club head (via rotating the shaft about its axis) until the leading edge of the club head contacts two of the horizontal rails. During rotation of the iron club, the vertical plane (established by the elongated contact rails) slides upward and downward along the inclined linear bearings to ensure the leading edge of the club head is substantially vertical when it contacts the two horizontal pins. The present gravity-driven slidable contact rail arrangement allows compensation for clubs of different offset (i.e. no offset, or fixed or variable offset). Also, because of the length of the contact pins, that span allows them to accommodate clubs of various shaft lengths without need to re-set any grip installation locations. If needed, a substantially vertical plane defined by at least three horizontal contact rails is preferred for accommodating central-shafted iron club heads. With either the two or three rail system, once the operator achieves the vertical orientation of the club head's leading edge, the shaft can be clamped in place ready for gripping.

In a preferred embodiment, additional alignment means consisting of a laser beam (or some other suitable visual reference line) and alignment indicia (such as dots) along the exterior of the handle grip and, optionally, additionally along the shaft of the club, can be used to further assure an accurate positioning of the grip during installation. In the case of a handle grip having a "reminder" ridge therein, such alignment dots along the exterior of the grip also provide a convenient visual reference to help an operator identify the top side of the grip. Installation of the grip itself can employ conventional techniques including applying double sided adhesive, or grip tape, to the butt-end of the shaft, covering the taped portion with an activating solvent, and fitting the grip over the taped portion of the club shaft. It will be recognized by those of ordinary skill in the art that the teachings of the present invention are also applicable to golf club alignment for installation of the preliminary underlisting in a two-part wrapped grip operation.

DETAILED DESCRIPTION OF THE PREFERRED EMBODIMENTS

Figure 1:
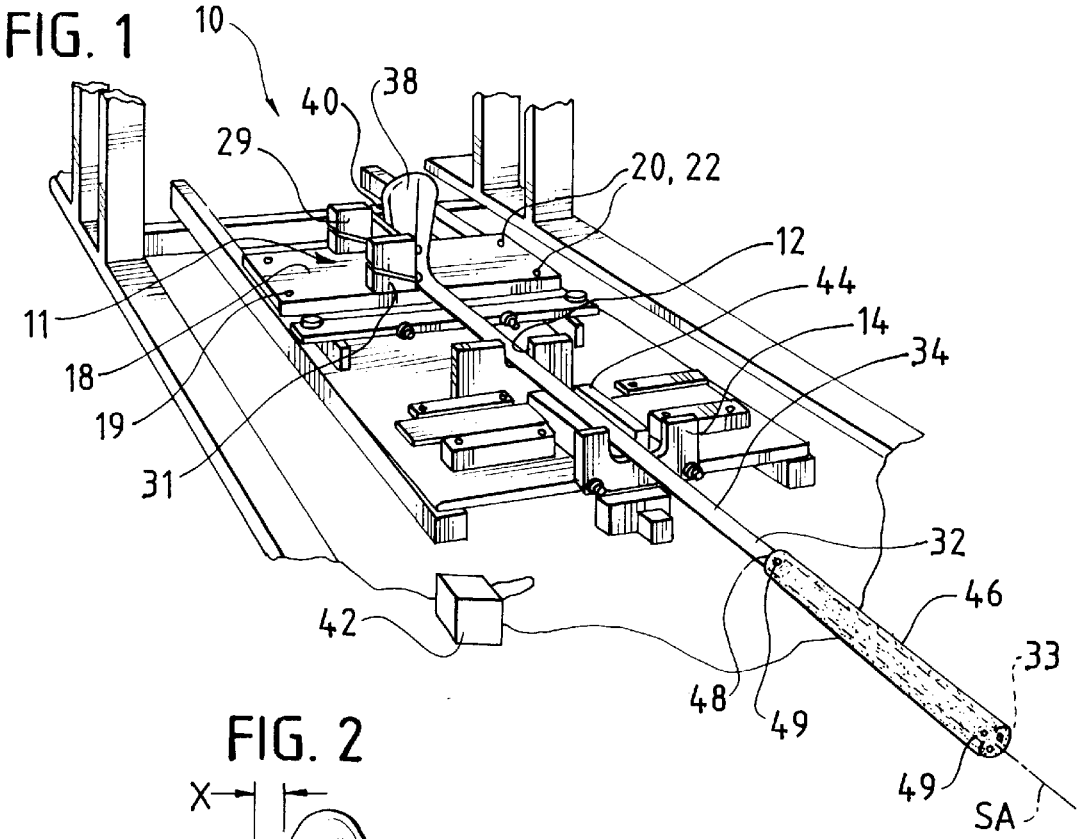
FIG. 1 is a perspective view of an iron golf club alignment station of the present invention, partially broken away.
Figure 2:
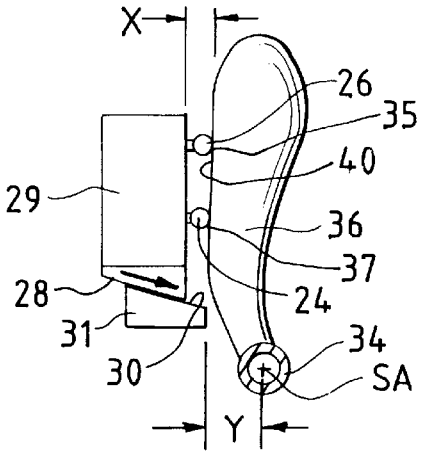
FIG. 2 is a front plan view, taken along lines 2—2 of FIG. 3, showing a leading edge of an iron golf club being aligned with a vertical plane.
Figure 3:
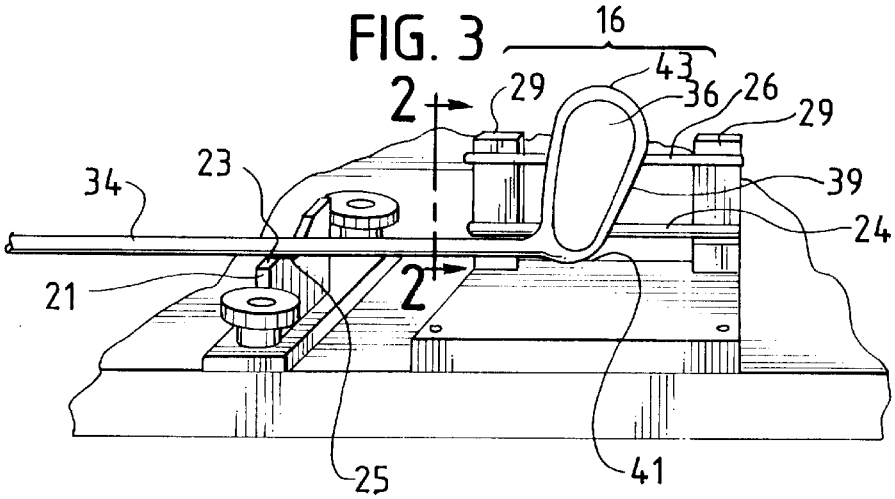
FIG. 3 is a right side elevational view, partially broken away, of the golf club alignment station of the present invention.

FIGS. 1–3 show the golf club alignment station 10 that is particularly suitable for heel-shafted irons. The alignment station 10 consists of one or more generally U-shaped shaft supports 12, 14, and a club head alignment area 16. The club head alignment area 16 includes a platform or tray 18 mounted by way of suitable securement means 20 to the alignment station 10. The securement means 20 may take the form of threaded fasteners 22, or an equivalent thereof, but the securement means 20 is preferably releasable as described later herein.

The tray 18 supports a gravity driven, self-adjusting, leading edge alignment assembly 11, which creates a vertical plane defined by a pair of elongated horizontal rails or contact pins 24, 26 oriented in parallel, one fixed above the other, and both transverse to the club head 36. The lower and upper horizontal contact rails 24, 26 are mounted on a pair of rail supports 29 so as to be fixed one above the other. Each rail support 29 is seated on an inclined base 31, and linear bearings 28, 30 facilitate movement of the rail supports 29 up or down along the corresponding inclined base 31. An iron-style golf club 32, having a shaft 34 and a club head 36, is placed in the alignment station 10. The club head 36 has a strike face 38 and a leading edge 40 formed along the lower end of the strike face 38 adjacent the sole 39. Advantageously, the shaft 34 of the golf club 32 is supported only by one or more U-shaped shaft supports 12, 14, so that the club head 36 is located and freely supportably maintained in the club head alignment area 16. The butt-end 33 of the iron-style golf club 32 extends rearwardly from the shaft supports 12, 14. The height of the U-shaped shaft supports 12, 14 relative to the platform 18 is such that the heel end 41 of the club head 36 freely floats above the surface of the platform 18. This feature allows for a minimum number, i.e. only two, contact points between the leading edge 40 and the leading edge alignment assembly 11.

It will be understood that the elongated contact rails 24, 26 are sufficiently long enough (i.e. preferably 6 inches or more in length), so as to accommodate respective clubs of various shaft lengths, all without need to re-set any grip alignment structure. That is, no matter what the length of shaft 34 is present for a given club 32, the club head's leading edge 40 will still be in contact with the two contact rails 24, 26.

An operator rolls the golf club 32 by rotating the shaft 34 about its axis until the leading edge 40 of the club head 36 moves into direct contact with both horizontal transverse rails 24, 26 somewhere along their length. As the club head 36 rotates, the gravity biased rail supports 29 move up or down along the inclined bases 31 until both rails 24, 26 contact the club head's leading edge 40, ensuring a vertical orientation of the leading edge 40. This orientation, in effect, simulates for grip alignment purposes the club head and shaft's orientation, relative to a golfer's eyes, as would occur in the address position, i.e. when the golfer (not shown) is set up to the golf ball (not shown) and ready to hit the ball with the club head 36.

Whether the leading edge 40 of the club head 36 initially contacts the lower horizontal rail 24, which would occur at a contact point 35 nearest the heel end 41 of the club head 36, or initially contacts the upper horizontal rail 26, at a contact point 37 nearest the toe end 43 of the club head, depends on several factors. These factors include the orientation of the club head when the operator places it into the alignment station 10, the offset present, if any, in the leading edge 40 of strike face 38 (relative to the axis of shaft 34), and the perpendicular distance (see reference letter y in FIG. 2) from a shaft axis (i.e. or shaft centerline) SA extending through the U-shaped shaft supports 12, 14 to the rails 24, 26. In order to achieve the desired vertical alignment of the leading edge 34, the operator in either instance simply rotates the club head 36 (by rotating the shaft about its axis) so the contact point 35 nearest the toe end 43 on leading edge 40 approaches the upper horizontal rail 26, or so the contact point 37 nearest the heel end 41 on the leading edge 40 approaches the lower horizontal rail 24. In either case, further such shaft rotation permits gravitational effects to cause the slidably-mounted rail supports 29 to move upward and downward along the linear bearings until the leading edge 40 contacts both of the rails 24, thus advantageously achieving only two points of contact between the club head leading edge 40 and the leading edge alignment assembly 11. Once the leading edge 40 of the club head 36 is so placed in a substantially vertical orientation, the operator then activates a clamp switch 42 (FIG. 1) which causes clamp 44 to secure the shaft 34 in place. As shown in FIG. 1, the clamp 44 is disposed between two U-shaped shaft supports 14, 12.

Figure 4:
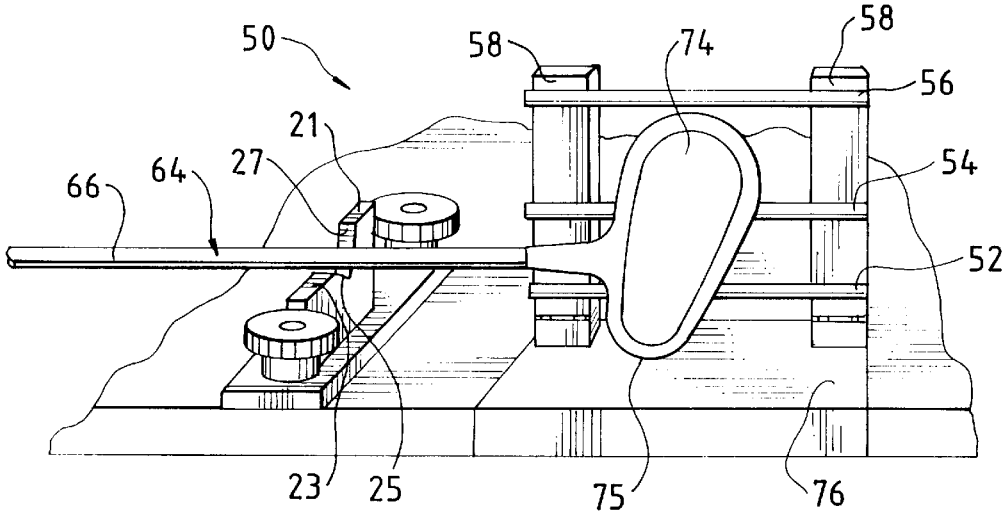
FIG. 4 is a right side elevational view, partially broken away, of a golf club alignment station of an alternative embodiment of the present invention particularly for use with central-shafted irons.

An additional support block 21 is preferably provided in order to supply a stop to prevent premature, potentially damaging contact of the club head 36 with the rails 24, 26. When inserting a golf club 32 in the alignment station 10, the shaft 34 first travels across a lead-in surface 23 of the additional support block 21, which leads to a V-shaped support notch 25. An inclined stop wall 27 is formed by the side of the support block 21 opposite the lead-in surface 23, as seen in FIGS. 3 and 4. The shaft then comes to rest in the V-shaped support notch 25, as well as in the U-shaped supports 12, 14.

Preferably, platform 18 is removably secured to the alignment station 10 in order to accommodate reversing the orientation of the horizontal rails 24, i.e. to permit installing handle grips onto left-handed iron clubs. When desired for aligning such left-handed clubs, the operator simply removes the fasteners 22, reverses the orientation of the horizontal rails 24 by rotating the platform 18° by 180°, and then re-secures the fasteners 22. For this purpose, the bores 19 in the platform 18 that receive the fasteners 22 are preferably arranged equidistantly from the shaft axis SA, or in some other arrangement that facilitates securing the platform 18 in either position described above. When this is done, the orientation of the additional support block 21 should also be reversed.

Figure 5:
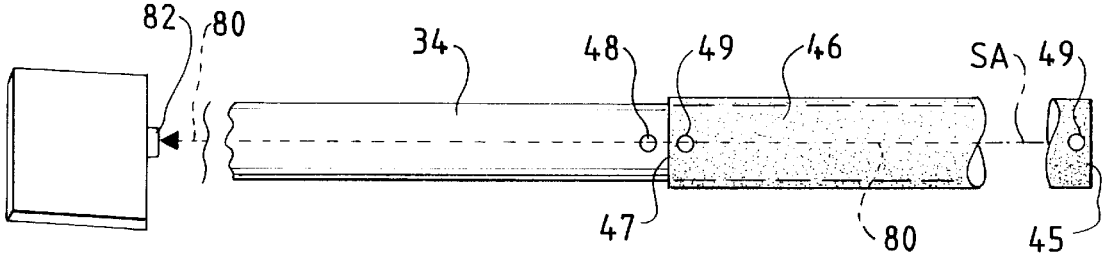
FIG. 5 is a partial enlarged top plan view of visual alignment structure for the alignment station of the present invention.

Once the clamp 44 is closed, the golf club 32 is in the correct, aligned orientation and is prepared to receive a grip 46 in a desired, pre-selected position and alignment. The grip 46 may be installed on the butt-end 33 of the shaft 34 in a conventional manner, such as first applying double-sided adhesive grip tape (not shown) to the butt-end 33, most preferably prior to inserting the iron-style golf club 32 in the golf club alignment station 10, applying an activating solvent to the exterior of the grip tape, and, after aligning and clamping the golf club shaft 34, pushing the grip 46 over the butt-end 33. (This same process can be used for properly aligning and applying so-called "underlistings" in a two-part, wrap-type grip installation.) In a preferred embodiment, see FIG. 5, alignment dots 48, 49, or similar graphics means, may be provided on the surface of the grip 46, by either molding or painting such dots on the top side of the grip, adjacent the butt-end 45 of the grip and adjacent the opposite open end 47 of the grip. Optionally, the alignment graphics may be printed on the surface of the shaft 34 as well. The alignment dots, 48, 49 permit more accurate alignment of the grip 46 when installing it on the shaft 34. The graphics means 48, 49 on the top side of the grip 46 provide a convenient reference for the operator to readily identify the top side of the grip, particularly in the case of a grip having a "reminder" ridge therein. Advantageously, such graphics means can be the same as graphics that may already be present on the grip 46 to give a golfer a visual reminder as to how to hold the club. A visual guide, such as a laser beam 80 emanating from a laser beam light source 82, is superimposed along the longitudinal axis of a properly aligned iron-style golf club's shaft 34, most preferably when the shaft 34 is clamped in its aligned orientation in shaft supports 12, 14 by clamp 44. The operator then aligns the graphics means 48 along the visual guide 80, and an accurate, reliable, repeatable alignment of each grip 46 onto corresponding golf club shafts 34, of any loft iron golf club 32, is achieved.

An alternate embodiment is presented in FIG. 4. This modified alignment station 50 is most appropriate for irons that are of a design where the shaft intersects the strike face at a more central location, as compared to more traditional heel-shafted irons. As seen in the drawing figure, this embodiment includes three horizontal alignment rails or pins, 52, 54, 56. The three alignment rails 52, 54, 56 create a vertical plane and extend between pin supports 58. As with the previously described two rail system, each of the three rail supports is slidingly mounted along linear bearings 60 on an inclined base 62. An iron-style golf club 64 having a central-located shaft 66 is inserted in the alignment station 50 so that the shaft 66 is supported by one or more U-shaped shaft supports (not shown), and the heel portion 75 of the club head 74 is adjacent lower rail 52.

The golf club 64 has an iron club head 74 with a leading edge (not shown) that can be aligned vertically by placing it in contact with two (of the three) biased alignment rails 52, 54, 56. Again, it will be recognized that the inclined bases 62 for the alignment rails 52, 54, 56 may be mounted on a platform 76 that is removable and reversible to orient the alignment rails 52, 54, 56 on an opposite side of a shaft centerline or shaft axis to accommodate left-handed iron-style golf clubs. It is seen that, with a three rail alignment system of this alternate embodiment, the club head's leading edge (which nearly always somewhat radiused) is still contacted by two pins, i.e. to establish a substantially vertically aligned club head for consistent grip alignment purposes.

Alternatively, the gravity-driven, self-adjusting leading edge alignment assembly 11 may instead take the form of a spring-loaded, pneumatic, or otherwise self-biasing pair of alignment rails to achieve the same function of bringing two rails that define a vertical plane up in a direction towards the leading edge of a golf club's strike face. Such alternate self-biasing rail systems need not be mounted on an inclined base, but still advantageously serve to place the leading edge 40 into a vertical orientation for purposes of proper grip installation.

Although the present invention has been described with respect to specific embodiments, those skilled in the art will understand that it is not intended to be limited thereto, and that variations may be made within the scope of the appended claims.

We claim:

1. An apparatus for aligning an iron-style golf club for properly oriented installation of a handle grip thereon, said apparatus comprising:

golf club shaft support means establishing a shaft axis;

at least two horizontally oriented contact rails extending transversely between a pair of rail supports, said contact rails defining a vertical alignment plane;

a pair of inclined support bases, each of said bases being provided with linear bearings thereon for slidably supporting one end of said rail supports and said bases being mounted on a platform;

said platform being located remote from said golf club shaft support means a distance of less than the length of a club shaft to which a grip is to be applied; and said contact rails being oriented parallel to said shaft axis and in one direction transverse to said shaft axis; said shaft axis extending through said shaft support means, so that when a golf club shaft of a golf club is supported in said shaft support means and a club head of said golf club is positioned over said platform, a leading edge of a strike face on said club head contacts two of said contact rails to achieve vertical alignment of said leading edge; and whereby a butt-end of said club shaft extends rearwardly of said shaft support means in a direction opposite said platform.

2. The apparatus of claim 1, further comprising means for clamping a golf club therein after the leading edge of the strike face of the golf club has contacted two of said contact rails.

3. The apparatus of claim 2, wherein said means for clamping a golf club comprises a clamp switch in communication with an automatic shaft clamp.

4. The apparatus of claim 3, wherein said golf club shaft support means comprises two U-shaped shaft supports, and said automatic shaft clamp being disposed between said two shaft supports.

5. The apparatus of claim 1, wherein said golf club shaft support means comprises at least one U-shaped support member.

6. The apparatus of claim 1, wherein said platform is removable and adjustable to facilitate mounting said rails in an opposite direction transverse to said shaft axis in order to accommodate gripping iron-style golf clubs for players of opposite hand.

7. The apparatus of claim 1, including a stop block shaft support member which has a lead-in surface terminating in a shaft support notch which permits insertion of the shaft to an initial rest position for subsequent rotation to engage said club head leading edge to two of said contact rails.

8. A method of properly orienting an iron style golf club for installation of a handle grip thereon, comprising the steps of:

forming a club head leading edge alignment assembly having at least two gravity-driven, parallel contact rails;

providing at least one golf club shaft support for supporting the shaft of a club while having its club head aligned;

placing a golf club with its shaft in said golf club shaft support and its head in contact with said leading edge alignment assembly such that the club head leading edge initially contacts a first one of said contact rails; and rotating the club shaft about its axis until said club head leading edge also contacts a second one of said contact rails, so as to properly orient said club for gripping.

9. The method of claim 8, and the further step of clamping said golf club shaft in said shaft support once said club is properly oriented.

10. The method of claim 8, and the step of installing a grip on the butt end of said shaft of said properly oriented club.

11. The method of claim 10, and the further step of using visual alignment means to ensure proper alignment of said grip on said club shaft.

12. The method of claim 8, wherein said step of placing said club shaft on said golf club shaft support includes the step of positioning said shaft in a support stop notch to prevent inadvertent damaging contact of said club head to said contact rails, and to permit proper subsequent shaft rotation to effect proper contact of said rails by said club head.

13. An apparatus for aligning an iron-style golf club for properly oriented installation of a handle grip thereon, said apparatus comprising:

golf club shaft support means establishing a shaft axis;

at least two horizontally oriented contact rails extending transversely between a pair of rail supports, said contact rails defining a vertical alignment plane;

a pair of support bases provided with a biasing force in a first direction, each of said bases being provided with linear bearings thereon for slidably supporting one end of said rail supports and said bases being mounted on a platform;

said platform being located remote from said golf club shaft support means a distance of less than the length of a club shaft to which a grip is to be applied; said contact rails being oriented parallel to said shaft axis and in one direction transverse to said shaft axis; said shaft axis extending through said shaft support means, so that when a golf club shaft of a golf club is supported in said shaft support means and a club head of said golf club is positioned over said platform, a leading edge of a strike face on said club head can contact one of said contact rails which undergo biasing in said first direction by said support bases until said leading edge contacts two of said contact rails so as to achieve vertical alignment of said leading edge; and whereby a butt-end of said club shaft extends rearwardly of said shaft support means in a direction opposite said platform.

14. The apparatus of claim 13, wherein said biasing force is provided by spring means operating on said support bases.

15. The apparatus of claim 13, wherein said shaft support means comprises a plurality of U-shaped shaft supports.

* * * * *